United States Patent [19]

Arnold

[11] 4,259,039

[45] Mar. 31, 1981

[54] ADJUSTABLE VOLUME VANE-TYPE PUMP

[75] Inventor: Dieter Arnold, Düsseldorf, Fed. Rep. of Germany

[73] Assignee: Integral Hydraulic & Co., Dusseldorf, Fed. Rep. of Germany

[21] Appl. No.: 22,183

[22] Filed: Mar. 20, 1979

[51] Int. Cl.[3] ..... F04B 49/08

[52] U.S. Cl. ..... 417/220; 418/26; 418/31

[58] Field of Search ..... 417/220, 221, 204; 418/26, 31, 82, 268

[56] References Cited

U.S. PATENT DOCUMENTS

| | | | |
|---|---|---|---|
| 2,600,632 | 6/1952 | French | 417/220 |
| 2,823,614 | 2/1958 | Lapsley | 417/220 |
| 2,975,717 | 3/1961 | Rynders et al. | 417/220 |
| 3,079,864 | 3/1963 | Drutchas et al. | 417/204 X |
| 3,107,628 | 10/1963 | Rynders et al. | 418/26 |
| 3,756,749 | 9/1973 | Aldinger | 417/220 |

FOREIGN PATENT DOCUMENTS

| | | | |
|---|---|---|---|
| 2521367 | 11/1976 | Fed. Rep. of Germany | 417/221 |
| 2614602 | 10/1977 | Fed. Rep. of Germany | 417/221 |

*Primary Examiner*—Carlton R. Croyle
*Assistant Examiner*—Edward Look
*Attorney, Agent, or Firm*—Holman & Stern

[57] ABSTRACT

An adjustable volume vane-type rotary pump is disclosed in which volume control is obtained by adjusting the eccentricity of a control ring against which the vanes run. The control ring is urged towards its position of maximum eccentricity by a spring and position control of the ring is obtained by a piston and cylinder system operating in opposition to the spring. Operation of the piston and cylinder assembly is dependent on the dynamic pressure of fluid delivered by the pump so that when a certain speed of rotation is achieved the pressure exerted by the piston and cylinder system will be sufficient to overcome the force of the spring and adjust the position of the control ring.

4 Claims, 2 Drawing Figures

ADJUSTABLE VOLUME VANE-TYPE PUMP

BRIEF SUMMARY OF THE INVENTION

This invention relates to an adjustable volume vane-type pump in which volume adjustment is effected by altering the degree of eccentricity relative to the pump rotor of a control ring along which the vanes run.

A pump of this kind is disclosed in U.S. Pat. No. 3,549,281. A reacting force urging the control ring towards its position of maximum eccentricity is produced by a piston which is permanently stressed by system pressure and a further piston and cylinder system works in opposition to the first piston and has a larger working space which is stressed via the system pressure only up to a predetermined level and is then connected via a relay valve with an outflow, the relay valve being regulated against the force of the spring by means of system pressure. This pump has the function of a dead-head pump i.e., when exceeding a predetermined dead-head pressure, the control ring is displaced towards a position of minimum eccentricity so that there is produced only sufficient flow required for the compensation of leakage. The power which is required for this purpose is termed as the dead-head power and is significant smaller than the performance which would be necessary to generate a permanent flow in a constant volume pump of equal size via a pressure limiting valve. Dead-head pumps of this type are commonly used in the hydraulics industry at constant rates of revolutions.

A utilization of pressure source for motor vehicle hydraulics, especially for servo-controls, has formerly been eliminated, since such servo-controls require a flow amount which does not depend on the system pressure necessary for the support. At the present time, in such control systems there are utilized constant volume pumps which are provided with volume divider switches and which at a higher rate of revolution would absorb too much power. Even absorption of power caused by speed induced idling pressures is undesirable.

It is therefore an object of the present invention to provide an adjustable volume vane-type pump in which the above discussed disadvantages are minimized, i.e., in which feed flow based on the driving speed (rpm) of the pump, starting with a predetermined rate of revolutions no longer, or at least only slightly increases and this flow is substantially independent of the variable consumable pressure. The structure should additionally be simple, inexpensive, space saving and safe to operate.

The present invention is based on the principle that the vanes during the time they proceed through the pressure zone, operate with their inner edges as small pump pistons (DE PS 809,131). While however in the prior art constructions, the pressure fluid is forced from the inner edges of the vanes during the inward movement and is applied directly to the pressure system, in the instant pump, there develops a flow into the pressure system by means of an adjustable throttle valve. The pressure head, dependent on pump speed, which thereby develops is utilized for adjusting a control ring governing piston. In order that only a portion of pressure, dependent on the rate of revolutions of the pump, is utilized, the piston has two opposed working spaces one of which is subject to the system pressure and the other of which is subject to the above-mentioned pressure head. The difference of the two pressures is effective on the piston.

If required, it is also possible to cause the system pressure to affect a further working area of the piston and cylinder system and to thereby obtain an additional dead-head effect. The additional working area can for example be the piston rod area.

DETAILED DESCRIPTION

Figure 1:
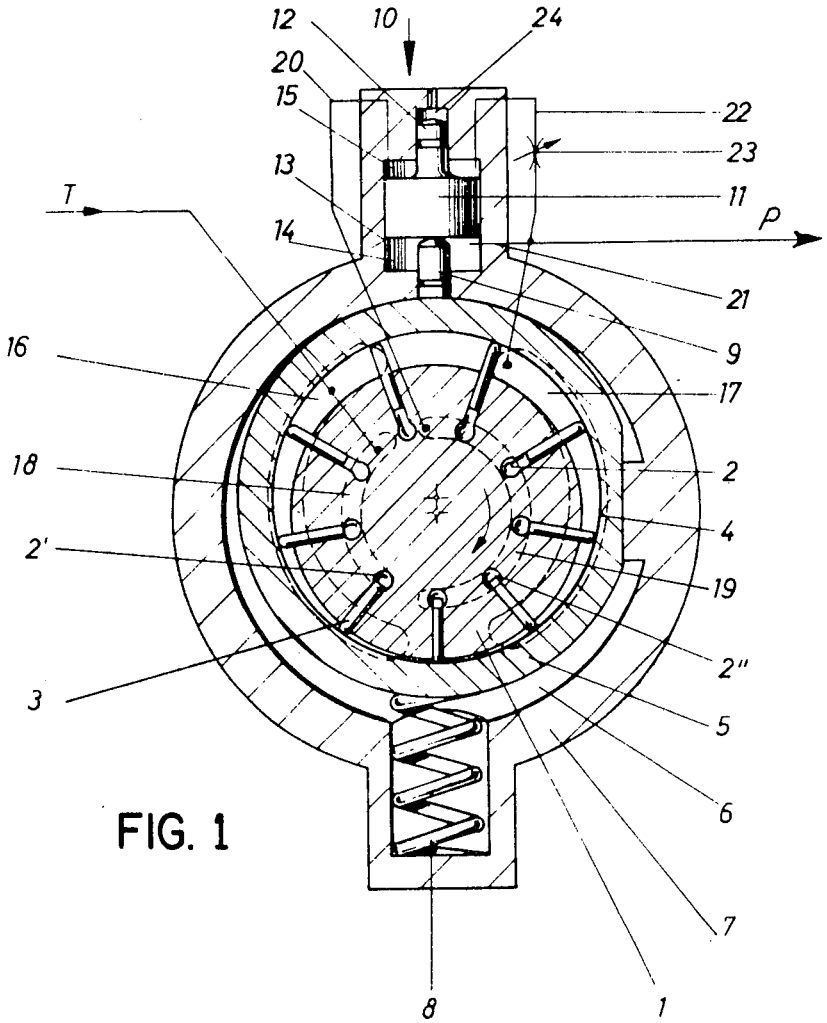
FIG. 1 is a cross-sectional view of a vane-type pump.

In the pump shown in FIG. 1, a rotatable rotor 1 is provided with a series of axially parallel and radially extending slots 2 in which vanes 3 are slidebly received with a small amount of play. The outer ends of the vanes 3 are in contact with the inner surface 4 of a control ring 5 which is eccentrically arranged relative to the rotor 1. The control ring 5 is displacedly arranged in a hollow space 6 within a housing means 7 and is stressed by pressure applying means in the form of a spring 8 supplying a force in a direction urging the control ring towards its position of maximum eccentricity. In the counterdirection, the control ring 5 is stressed by means of a piston rod 9 of a piston and cylinder system 10. The piston rod 9 is in operational contact with a piston 11 which is connected with a further piston rod 12. The piston 11 defines working spaces 14 and 15 in a cylinder 13. Piston rods 9 and 12 are closely guided. In a lateral plate which is not shown in detail and which covers the control ring 5 and a portion of the rotor 1, there are arranged a suction port 16 and a pressure port 17 as indicated in broken lines. The suction port 16 is located in the area of the increasing volume of the pump working chambers formed between adjacent vanes while the pressure port 17 is arranged in the area of decreasing volume of the working chambers. The two areas are referred to as the suction area and the pressure area respectively. The inner end portions 2' of the slots 2 are connected with a curved groove 18. Groove 18 and suction port 16 are both connected with a suction pipe T. The inner end portion 2'' of these slots 2 are connected with the working space 15 by means of pipe 20 and a further groove 19. A hydraulic system P is connected to the pressure port 17 with a connection means 21 branching off from said hydraulic system P to the working space 14. Between the working space 15 and the hydraulic system P and the pressure port 17 there is a connection 22 in which is mounted an adjustable throttle 23.

When the pump is in operation, the rotor 1 rotates in the direction indicated by the arrow and pressure is supplied to the hydraulic system P. At the same time fluid is sucked under the vanes 3 in the suction area and is then forced into the groove 19 and from there by means of pipe 20 to the working space 15 and the connection 22 to the throttle 23 on the other side of which system pressure prevails. At the throttle 23 a pressure head therefore develops which is comprised of a static portion corresponding with the system pressure and a dynamic portion which depends on the rate of revolution of the rotor. Since system pressure is also present in the working space 14, only the dynamic portion functions as the resultant pressure influencing piston 11. As long as this portion does not suffice to overcome the initial stress of the spring means 8, the pump delivery increase is proportional to the rate of revolution of the rotor. At a predetermined rate of revolution of the rotor however, the dynamic pressure becomes sufficiently high that the piston 11 moves downwardly overcoming the force of the spring means 8 and displaces the control ring 5 to a position of lesser eccentricity resulting in a lower pump delivery. The change in the eccentricity of ring 5 takes place independently of the pressure existing in the hydraulic system P. The prerequisite for this is that the inner forces which affect the control ring 5 are guided into a housing secure support and the resulting force of pressure is so guided that no force components develop in the direction of the piston or spring force.

Figure 2:
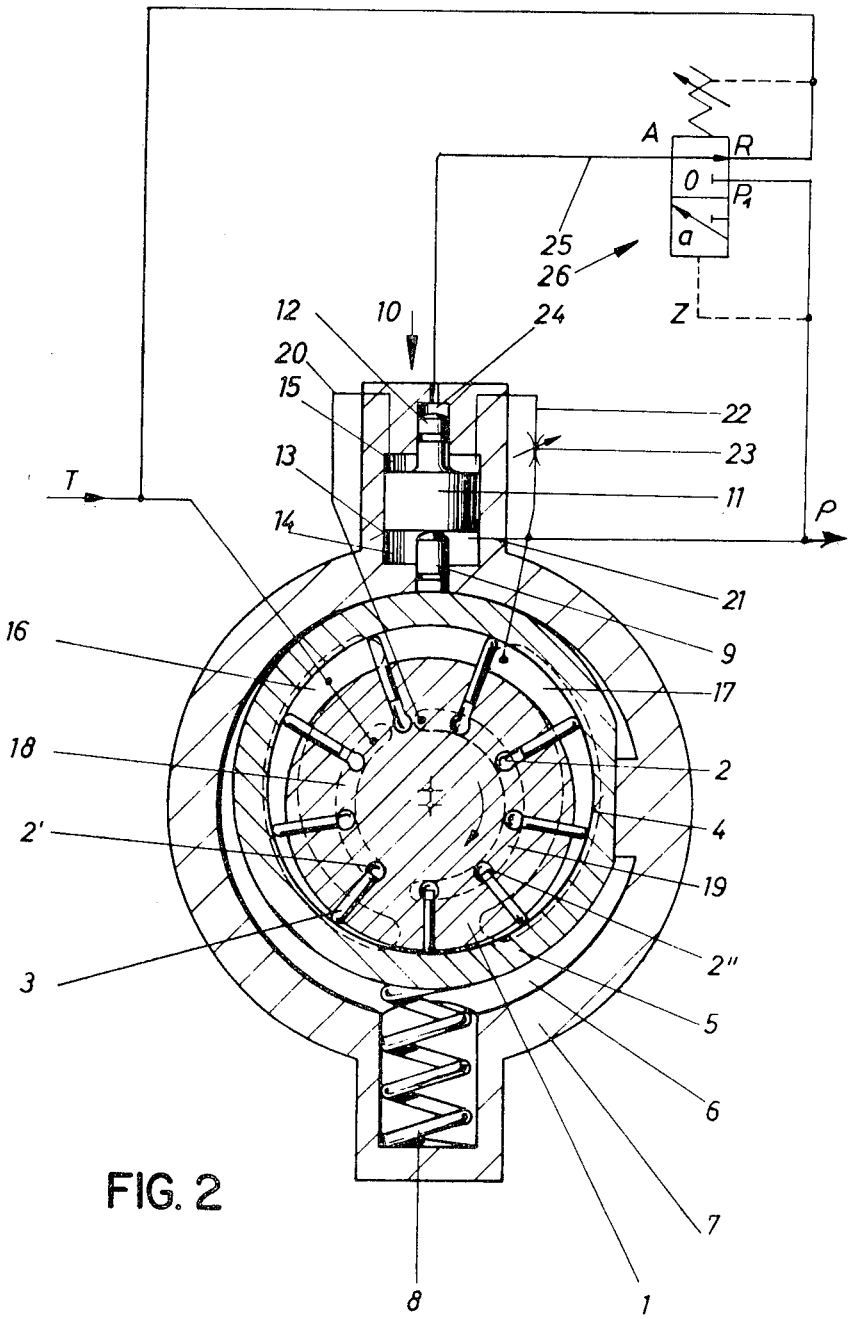
FIG. 2 is a cross-sectional view of a pump in accordance with the invention similar to the pump shown in FIG. 1 and which is provided with an additional working area and a regulating valve.

FIG. 2 shows an embodiment which can be utilized if an additional dead-head effect is desired. In an otherwise identical structure of pump to the FIG. 1 embodiment, the cylinder space 24, which receives the piston rod 12, is no longer connected with the atmosphere as in FIG. 1, but is connected with a connection means A of a pressure-constant relay valve 26 by means of a pipe 25, the relay valve 26 being provided with two further connections means R and P1. A is connected with R in a final position O which is effected by means of the force of the spring, while P1 is closed. During pressure stress with the system pressure via a control pipe Z, a switching into the switch position a is made in which R is closed and P1 is connected with A. Connecting means R is connected with the suction pipe T while connection means P1 is in communication with the hydraulic system P.

Above a predetermined pressure which is adjustable at the relay valve 26 there takes place a switching from the switch position O into the switch position a independent of the respectively prevailing number of rotations, so pressure is exerted in the cylinder area 24 to provide an additional force on the lift ring 5 via the piston rod 12, the piston 11 and the piston rod 9. At a certain rate of revolution, there results in the common manner a dead-head effect. If additionally the rate of revolution is varied, then both influences overlap.

The present invention is not limited to the embodiments as herein described and numerous modifications can be made within the scope of the invention as defined in the appended claims. For example, it is possible to construct the piston and cylinder system in two parts and to have one part being effective on the side of the spring means in the direction of the spring. It is further possible to vary the sizes of the effective areas. Also it is possible not to utilize a relay valve and basically in the entire pressure area to work with an adjustment which depends on the pressure and the rate of revolution.

What is claimed is:

1. An adjustable volume pump comprising a rotor, a plurality of generally radially extending slots in said rotor, vanes mounted in said slots for radially inward and outward movement, a control ring surrounding said rotor and being eccentrically adjustable relative to the rotor, the vanes having outer portions adapted to move along an inner surface of the control ring in operation of the pump, a pressure applying means for urging said ring towards one extreme position, a piston and cylinder system for adjusting the position of the control ring in opposition to said pressure applying means, a pair of lateral plates covering opposite sides of the rotor and control ring respectively, a suction port in at least one of said lateral plates communicating with working chambers of the pump defined between adjacent vanes in a position when said working chambers expand during rotation of the rotor, a pressure port in at least one of said lateral plates communicating with said working chambers in a position when the working chambers contract during rotation of the rotor, a first groove means in at least one of said plates communicating with inner ends of said slots in said position when said working chambers expand, a second groove means in at least one of said plates communicating with the inner ends of said slots in said position when said working chambers contract, said piston and cylinder system defining first and second working spaces on opposite sides of the piston respectively, pressure fluid admitted to said first working space operating to urge the piston in the same direction as the force applied by said pressure applying means and pressure fluid admitted to said second working space operating to urge the piston in a direction opposed to the force applied by said pressure applying means, said pressure port being in fluid flow communication with said first working space and being in fluid flow communication with said second working space through a throttling means and said second groove means being in fluid flow communication with said second working space.

2. The pump of claim 1 wherein said piston and cylinder system includes a third working space, pressure fluid admitted to said third working space being operable to urge the piston in a direction opposed to the force applied by said pressure applying means and connection means is provided for placing said third working space in communication with said pressure port.

3. The pump of claim 2 wherein said third working space is defined at the free end of a piston rod associated with said piston.

4. The pump of claim 2 or claim 3 including a relay valve means for introducing to said third working space pressure prevailing at said pressure port or pressure prevailing at said suction port and means for automatically switching said third working space between said prevailing pressures dependent on the level of pressure prevailing at the pressure port.

* * * * *